US005678542A

United States Patent [19]

Maffatone

[11] Patent Number: 5,678,542

[45] Date of Patent: Oct. 21, 1997

[54] DECOMPRESSION GAS SWITCHING MANIFOLD

[76] Inventor: Anthony Neil Maffatone, 68 Elizabeth St., Bloomingdale, N.J. 07403

[21] Appl. No.: 654,397

[22] Filed: May 28, 1996

[51] Int. Cl.[6] ..... A62B 9/04

[52] U.S. Cl. ..... 128/205.24; 128/201.27; 128/201.28; 128/202.14; 128/204.26; 128/204.27; 128/203.25; 405/186

[58] Field of Search ..... 128/200.19, 201.27, 128/201.28, 201.29, 202.14, 204.26, 204.27, 204.28, 205.11, 205.13, 205.14, 205.16, 205.22, 205.27, 205.24, 203.25; 405/186

[56] References Cited

U.S. PATENT DOCUMENTS

| | | | |
|---|---|---|---|
| 2,238,759 | 4/1941 | Vestrem | 128/201.27 |
| 2,406,888 | 6/1946 | Meidenbauer, Jr. | 128/204.26 |
| 3,016,053 | 1/1962 | Medovick | 128/204.26 |
| 3,351,089 | 11/1967 | Garrahan | 128/205.24 |
| 3,693,653 | 9/1972 | Cramer et al. | 128/204.26 |
| 4,062,356 | 12/1977 | Merrifield | 128/205.22 |
| 4,148,311 | 4/1979 | London et al. | 128/210 |
| 4,227,521 | 10/1980 | Hart et al. | 128/202.14 |
| 4,328,798 | 5/1982 | Isaacson | 128/202.27 |
| 4,449,524 | 5/1984 | Gray | 128/205.24 |
| 4,498,471 | 2/1985 | Kranz et al. | 128/204.26 |
| 4,838,256 | 6/1989 | Miltz | 128/202.27 |
| 4,870,961 | 10/1989 | Bernard | 128/202.27 |
| 5,159,924 | 11/1992 | Cegielski et al. | 128/203.12 |
| 5,273,030 | 12/1993 | Crome | 128/202.11 |

FOREIGN PATENT DOCUMENTS

| | | | |
|---|---|---|---|
| 0621398 | 6/1961 | Canada | 128/204.26 |
| 0569247 | 11/1993 | European Pat. Off. | 128/203.12 |

OTHER PUBLICATIONS

Menduno, (1992) "Safety First: An Analysis of Recent Diving Accidents, " technical Diver, A companion to aqua-Corps Journal, vol. 3.2, (Oct.) pp. 4, 6–9, 17.

Hamilton, R.W. "Call it 'high–tech' diving." pp. 6–9, 50.

Hamilton, R.W. "Technologically inspired: the closed circuit rebreather." 11–4.

Allen (1993) "Mixed Opinion: The British Sub–Aqua Club's Report on the Use of Enriched Air Nitrox," Aqua Corps Journal NG (Jun.):38–40.

Incident reports, AquaCorps Journal, pp. 51–2,61–2.

(Trimix . . . ) AquaCorps Journal pp. 37,42.

"40 " Series Ball Valves (1988–92) Whitey product catalogue W–1288.

Plug Valves (1991) Nupro product catalogue N–791.

Amron product catalogue (1985,1989,1994) pp. 188,194.

Diving Systems International brochure (1989).

Interspiro brochure (undated).

Divematics, VSA, Inc. brochure (undated).

Dr. R.W. Bill Hamilton, "Rethinking Oxygen Limits," technical Diver, companion to aquaCorps Journal, vol. 3.2, Oct., 1992, 16–19.

Steven M. Barsky, "A Close Look at Full Face Masks," tek. Guide (Spring 1993)., pp. 5–15.

*Primary Examiner*—Vincent Millin
*Assistant Examiner*—Virendra Srivastava
*Attorney, Agent, or Firm*—Klauber & Jackson

[57] ABSTRACT

A decompression gas switching manifold for technical diving with full face mask includes separate manifold blocks (for travel/bottom and decompression gases) which can be connected or isolated by an isolation valve.

22 Claims, 4 Drawing Sheets

DECOMPRESSION GAS SWITCHING MANIFOLD

BACKGROUND OF THE INVENTION

1. Field of the Invention

The present invention relates generally to scuba diving, and more particularly, is directed to a device for providing safe ascent and decompression during technical dives.

2. Description of Prior Art

When returning to the surface from a deep water dive, it is necessary for the diver to decompress. To do so, the diver makes frequent stops on the way to the surface. Generally, the U.S. Navy Standard Air Decompression Table requires the diver to rise at a controlled rate of sixty feet per minute, while stopping at prescribed depths. This permits the nitrogen in the tissues of the diver to come out of solution and be expelled from the blood before expansion and before bubble formation constricts circulation. Otherwise, a situation known as decompression illness or the "bends" can occur, which can be deadly.

"Recreational" diving is generally defined as no-stop scuba diving with air to depths of about 130 feet maximum. Diving beyond these limits, i.e. to deeper depths and/or for longer bottom times that require decompressions stops, whether for recreational or other purposes, may be termed "advanced" diving. Further, diving beyond the traditional recreational limits using equipment other than standard wetsuits for thermal protection has come to be known as "technical" diving. Technical diving encompasses "special-mix diving," i.e. dives using gas mixtures other than air. Nitrox, a mixture of oxygen and nitrogen with less oxygen than air, is used for underseas habitats, and permits long bottom times at depths of 10 to 60 meters, with little or no decompression required. This term is also used for mixtures of air and oxygen more properly called "enriched air nitrox" (EANx). This method is useful in depths of 10 to about 40 meters, and allows increased bottom times with no increase in decompression time. Special mix methods also include "trimix" and heliox diving. Trimix involves the use of mixtures of helium, nitrogen and oxygen that are appropriate for diving in the range of 50 to 100 meters. At the deeper end of this range, mixtures of helium and oxygen, with little or no nitrogen, are better. Such diving takes considerable operational planning and preparation because of gas logistics problems, and in most cases, special decompression tables are needed. Logistics considerations apply first at the level of mixing, which takes both skill and equipment, and later at the level of breathing, since all the gases needed for a deep trimix or heliox dive cannot normally be carried by the diver.

Another special mix method involves the use of rebreathers, which supply gas to the diver in a closed or semi-closed loop from which $CO_2$ is absorbed. Although such systems have been used for years by many navies, due to cost and complexity they are not readily available to recreational divers.

Although not completely standardized, in diving mix terminology "special mix" usually applies to all diving gases other than air, including trimixes of oxygen, helium and nitrogen, mixtures of oxygen with other inert gases (helium, neon, nitrogen) and to enriched air mixes. A travel mix is a gas mix, typically carried in stage bottles, used on descent prior to beginning the working portion of a dive. Travel mix can be used to provide decompression advantages in conjunction with special tables, and/or to avoid the problems of hypoxia (oxygen starvation) near the surface when using a bottom mix with a low oxygen fraction ($PO_2$). A bottom mix is the gas mix (air, enriched air, trimix or heliox) used during the working and/or deepest portion of a dive. An intermediate mix or decompression mix is the gas mix(es) used during the decompression phase of a dive. Most special mix diving operations follow a planned decompression procedure of switching to one or more enriched air mixtures during decompression, followed by pure oxygen at the 20 and 10 foot stops to eliminate any helium as soon as possible and maximize allowable oxygen partial pressures. Enriched air, oxygen or combinations thereof can be used for decompression during extended air diving.

According to a recent diving accident analysis (See Menduno, "SAFETY FIRST: An Analysis of Recent Diving Accidents," technical DIVER, companion to aquaCorps Journal, vol. 3.2, October 1992 pp. 8/9), "inadequate gas management" is a significant factor in many diving accidents and incidents. Nitrogen levels must be reduced at depth to reduce the risk of nitrogen narcosis, but the most critical factor in special mix diving for technical divers is regarded as oxygen management. Although oxygen tolerance in diving depends upon many factors and is not an exact science, exposure to excessive $PO_2$ (i.e., 1.6 atm or more) must be limited to avoid oxygen convulsions, which result from the central nervous system (CNS) toxicity of oxygen. See R. W. Hamilton's "Rethinking Oxygen Limits", technical DIVER vol. 3.2 (October 1992), pp. 16–19. With technical divers pushing these limits, the potential danger of such underwater seizures is spurring the development and use of full face mask and manifold block systems which act to prevent drowning in the even that a diver loses consciousness, and also facilitate the use of underwater communications. It is reported that many people believe that full face masks and manifold blocks will become the standard equipment for technical diving, much as it has in commercial and professional diving communities. According to Hamilton, "Oxygen Limits," Id, wearing a full face mask also creates the need for connecting blocks to enable gas switching and the easy sharing of gas from diver to diver in emergency situations.

According to Barsky in "A Close Look at Full Face Masks," tek.GUIDE (Spring 1993), PP. 5–15, "Many people believe that full face masks represent the next evolution in open-circuit diving systems due to their many safety and performance benefits. Though none of the existing mask and block systems are specifically designed for technical diving applications, for example with respect to redundancy considerations or gas switching capability, numerous teams are beginning to adapt these systems for extended range diving." Barsky described the two main choices for technical divers for full face masks at that time as the AGA and the EXO-26R, manufactured by Diving Systems International. In describing diving with full face masks, Barsky notes that "In an out-of-gas emergency, gas sharing with a full face mask is very awkward;" it may be preferable to carry a separate scuba regulator and face mask. When using a full face mask in deep or decompression diving, the diver should carry a back-up gas supply, which should be connected to a manifold block or "bail-out block." Such a block is usually positioned on the diver's harness, on the right side, at chest level. Diving Systems international reportedly manufactures a bail-out block for the EXO-26 "that can be used for technical scuba diving but is more suited to surface supplied diving." This "manifold block assembly" provides a check valve and four low pressure outlets to supply a mask, dry suit and accessories.

Barsky, Id., describes a possible arrangement for a bail-out block that might be better suited to technical diving, as illustrated in FIG. 1. The block contains three non-return valves, so that should any one of the low pressure supply hoses fail, the breathing gas would not be lost in the ruptured hose between the first and second stage. There are three on-and-off valves in this block, all shape and color coded. The first valve is for the main supply, the second for a second gas mix, and the third valve is for the bail out. It is stated that the valves should have some sort of positive "locking" system to ensure that they will not be accidentally opened. Such a block provides enough ports to accommodate a dry suit, a full face mask and a back-up regulator. Barsky notes that as an additional back-up, one could also install a quick-disconnect fitting between one's primary first stage and the full face mask and between one's back-up regulator and first stage. If a diving partner's gear is set up in the same way, in the event of a primary first stage failure, one could disconnect one's mask from the primary and connect to the partner's secondary mix or bail-out.

Another diving apparatus, the DIVATOR MK II, produced by INTERSPIRO U.S. Inc. of Branford, Conn., provides a full face mask and a manifold block with an extra air connector to connect/disconnect a surface supply hose with quick coupling.

U.S. Pat. No. 4,449,524 discloses SCUBA including a demand valve for controlling gas flow, demand valve bypass means and allows providing emergency help to a second user by connecting his bypass valve to the first bypass orifice.

U.S. Pat. No. 4,838,256 discloses SCUBA with connections for underwater transfer of air from one user's tank to another's. In the figures, plug valve (28) has four ports and two connection options.

U.S. Pat. No. 4,328,798 discloses a fire-fighter's breathing apparatus which allows for connection with a second mask to provide emergency air to a second user. FIG. 3 illustrates a rotatable fitting with a coupling tube.

U.S. Pat. No. 5,273,030 discloses a chest-mounted pilot's terminal block assembly which couples breathing gas from a regulator to a breathing mask. A second outlet may couple to a chest vest. Emergency breathing gas (at high pressure) connects to the terminal block through a fixed orifice and a small diameter high pressure hose.

U.S. Pat. No. 4,870,961 discloses a medical ventilator tube and manifold assembly having an interlocking manifold having five tubes for the ventilator and the circuit manifold, with tubing connections to the circuit for gas supply, return and pneumatic signals.

U.S. Pat. No. 5,159,924 discloses a medical gas mixer which permits choosing one of two gases for mixing with a third. The manifold (FIG. 2) has three gas inlets, a selector valve, a mixer, a regulator and a single outlet (139).

U.S. Pat. No. 3,693,653 discloses a fluid (gas) mixing regulator for mixing two gases, using two regulator systems with a single control which can maintain a selected ratio of gases to the outlet at variable flow rates. FIG. 1 shows a manifold with two inlets and one outlet.

U.S. Pat. No. 4,498,471 discloses a fireman's breathing apparatus with an improved two-stage pressure regulator, alarms, etc. The regulator fastens to an equipment harness.

U.S. Pat. No. 4,148,311 discloses apparatus for supplying mixtures of oxygen and air for aviation breathing, including a two-section supply regulator system.

OBJECTS AND SUMMARY OF THE INVENTION

It is an object of the invention to provide an independent, untethered diver wearing a full face mask with means for switching a decompression gas supply. It is a further object to provide the diver with means of access to multiple gas supplies for diving travel, bottom work, intermediate decompression and decompression use. Another object of the invention is to provide the diver with means of access to gas supplies which are diver-carried and/or exterior. Still another object of the invention is to provide these means for using and switching decompression gas supplies with safety measures which minimize the chances and consequences of diver error.

In accordance with the present invention, a decompression gas switching manifold for technical diving is provided which comprises a first manifold block containing connection and valve means for connecting one of two available gases for a diver's use during decompression, a second manifold block containing a quick-disconnect fitting for connection to the diver's regulator, connection and valve means for connecting one of two available bottom/travel gases plus connection and valve means for connecting a bail-out gas source, and further comprises isolation valve means for isolating or interconnecting the first and second manifold blocks.

Further in accordance with the invention, the valves and the handles thereof mounted on the first block are essentially identical, and include safety catch means for securing both valves in the closed position until the diver releases such catch. Such a safety catch can comprise a rigid pin or safety rod releasably inserted through holes in the T-handles of the valves when these handles are aligned end to end with both valves in closed position, and secured in place. The two valves on the second block are also essentially identical to each other, but differ in shape, characteristics and appearance from the valves on the first block to facilitate identification and prevent confusion between the valves on the first and second blocks, which serve different functions.

The present invention also comprises the manifold described above integrated and connected with a complete technical diving outfit comprising a full face mask, two sources of decompression gas, two sources of bottom gas and a source of bail-out gas. When thus installed, the manifold is preferably attached to the diver's chest harness (by a snap shackle or the like) on the diver's right side, with all gas hoses being routed under the diver's right arm. The manifold is so positioned that the gas sources so connected are positioned with those having the highest fractions of oxygen ($FO_2$) at the top (near the upper harness attachment point), with the gases having lower $FO_2$ near the bottom. That is, the valves for decompression gases (high $FO_2$) are located near the top on the first block (arranged in descending order of $FO_2$) and those for bottom gases (lower $FO_2$) are located near the bottom of the manifold on the second block to facilitate identification and minimize chances of confusion. The two sets of valves are further distinguishable by their different shapes, appearances and operating characteristics, as described in detail below.

The diving rig is further configured for safety by setting up the first stage air regulators so that the pressure for bottom gases (low $FO_2$) is about two to four PSI above the pressure for the decompression gas (higher $FO_2$) regulator. When thus configured and adjusted, the pressure differential prevents any admixture of decompression gases while bottom mix gases are in use.

The above and other objects, features and advantages of the invention will become readily apparent from the following detailed description thereof which is to be read in connection with accompanying drawings.

DETAILED DESCRIPTION OF THE INVENTION

Figure 1:
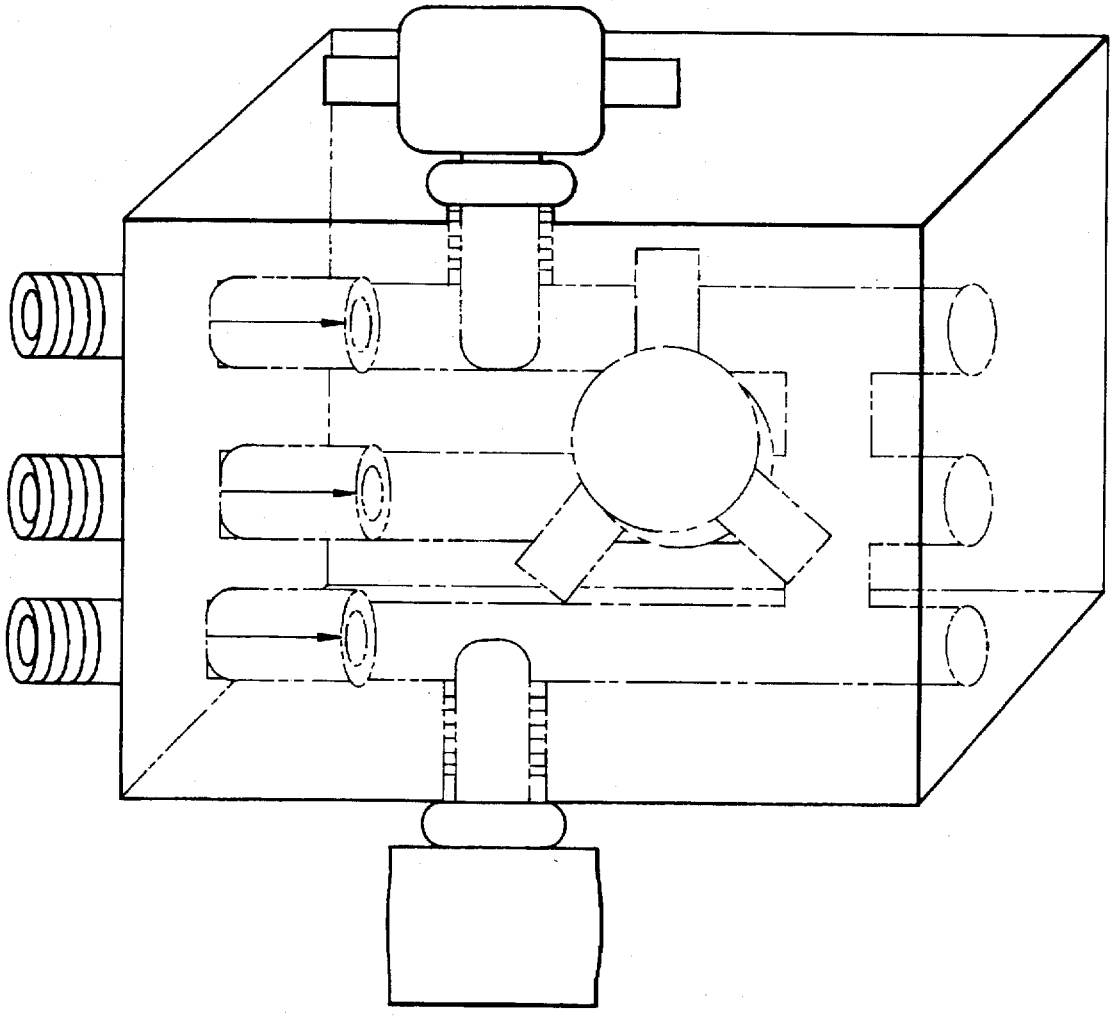
FIG. 1 PRIOR ART
FIG. 1 is a cross-sectional view of a prior art "bail-out" block for full face mask diving.
Figure 2:
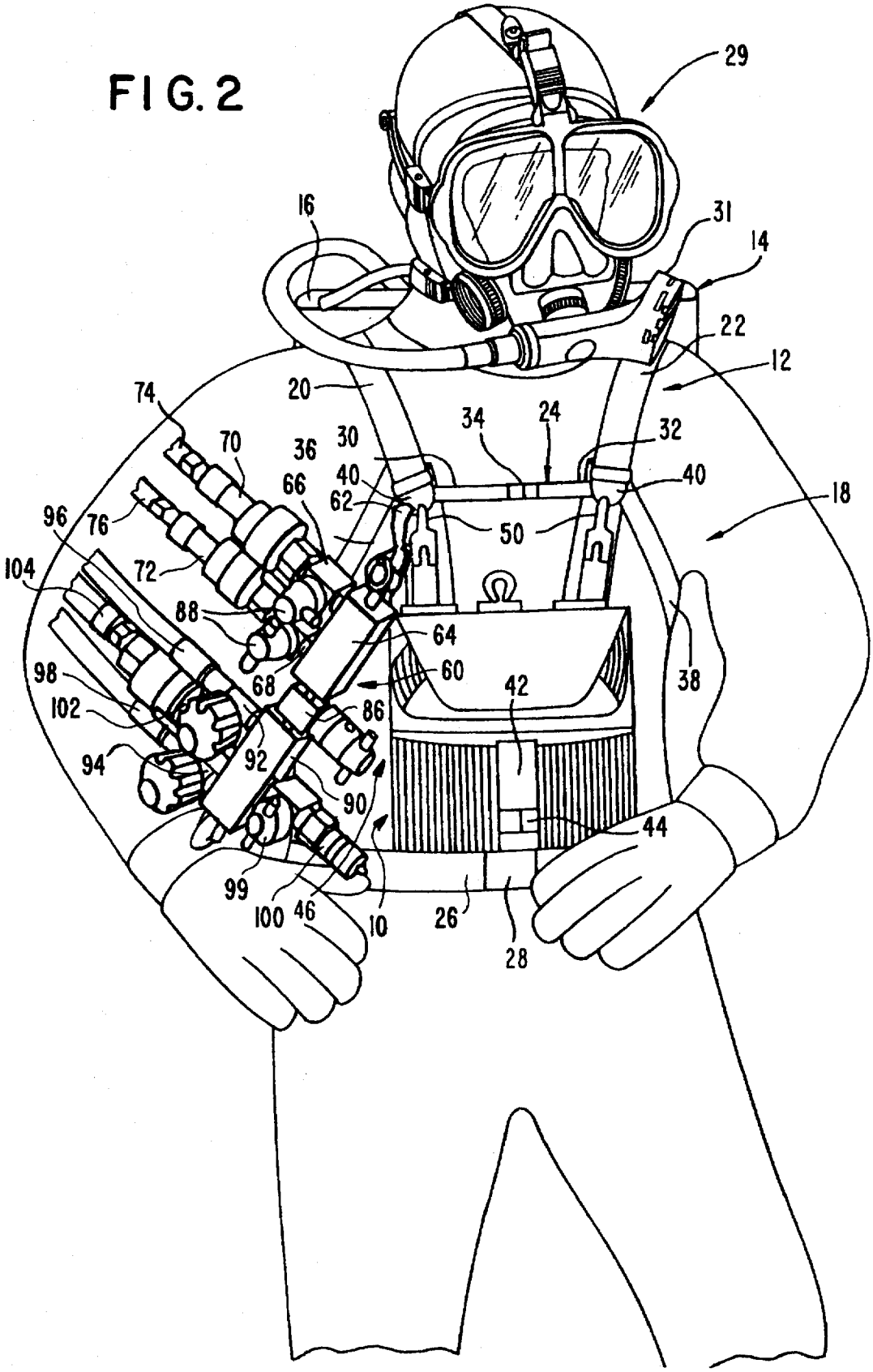
FIG. 2 is a front view of a decompression switching manifold according to the present invention, shown being worn by a diver.

Referring to the drawings in detail, and initially to FIG. 2, a gas switching manifold decompression 10 according to the present invention is removably attached to a diving harness 12 worn by the diver.

Diving harness (12) can be a conventional diving harness such as the Miller Diver's Harness, available from Diving Systems International of Santa Barbara, Calif. In the embodiment shown, diving harness (12) includes a tank holding device (14) intended to be positioned at the rear of the torso of the diver when harness (12) is worn by the diver, for holding one or more oxygen tanks (not shown). Although not shown in detail, such tank holding device (14) preferably includes a metal plate (16), as is conventional. A plurality of straps (18) are secured to tank holding device (14), and are used to secure diving harness (12) and tank holding device (14) thereof on the torso of the diver.

Preferably, the plurality of straps (18) include opposite shoulder straps (20) and (22), an upper torso strap (24), a waist securing strap (26) and a mid-torso strap (not shown).

Specifically, each shoulder strap (20) and (22) includes one end connected to the opposite upper ends of metal plate (16) of tank holding device (14), with the opposite ends of shoulder straps (20) and (22) hanging down over the front of the torso of the diver and extending to the waist area of the diver. Waist securing strap (26) is connected to the lower end of metal plate (16) of tank holding device (14) and has opposite free ends that extend around the front of the waist of the diver. A quick release buckle (28) is secured to one free end of waist securing strap (26) to secure the free ends together and thereby secure waist securing strap (26) about the waist of the diver. Quick release buckle (28) can be any suitable mechanism, for example, similar to ones found in the seat buckles of automobiles. Further, the lower free ends of shoulder straps (20) and (22) are connected, for example, by sewing, to the respective free ends of waist securing strap (26).

Upper torso strap (24) releasably connects shoulder straps (20) and (22) together at the front of the upper torso of the diver. In this regard, upper torso strap (24) is formed by a first strap (30) connected to shoulder strap (20) at the front of the upper torso of the diver and a second strap (32) connected to shoulder strap (22) at the front of the upper torso of the diver. The free ends of straps (30) and (32) face each other and have a quick release connector (34) for securing the free ends together. Quick release connector (34) can be any conventional quick release coupling device, for example, of the type conventionally found on back packs, belly bags, and the like.

The mid-torso strap (not shown) is identical to upper torso strap (24) and is connected between shoulder straps (20) and (22), substantially midway between upper torso strap (24) and waist securing strap (26). The mid-torso strap is behind optional safe ascent/decompression device (10) in FIG. 2, and therefore, cannot be seen.

Finally, stabilizing straps (36) and (38) have one end connected to the junctures of straps (30) and (32) with shoulder straps (20) and (22), respectively. The opposite ends of stabilizing straps (36) and (38) are connected to the respective lower ends of metal plate (16).

By means of quick release buckle (28) associated with waist securing strap (26), quick release connector (34) associated with upper torso strap (24) and the quick release connector (not shown) associated with the mid-torso strap (not shown), diving harness (12) can be removably secured on the torso of the diver.

In addition, eyelets (40) are provided at different heights on the front of shoulder straps (20) and (22), and a short strap (42) is secured substantially perpendicularly to quick release buckle (28) so as to extend from opposite sides of buckle (28). A releasable securing and tightening mechanism (44), of a conventional nature, is secured to one free end of short strap (42). Eyelets (40), clips (50) and short strap (42) are used to releasably secure safe ascent/decompression device (10) to diving harness (12).

A full face mask (29) (covering eyes, nose and mouth) such as an EXO-26 or equivalent, with regulator (31) is included in the diving rig.

Finally, the decompression gas switching manifold (60) is releasably attached to eyelet (40) on the diver's right side by stainless steel snap shackle (62). Preferably the lower manifold block is also attached to a harness eyelet (not shown) by a second snap shackle. The manifold is shown in detail in later figures. The uppermost manifold block (64), the decompression gas block, contains valves (66) and (68) with stem quick disconnects (70) and (72) which are connected to hoses (74) and (76), respectively. Valve (66) and associated hose (74) are connected to tank (80), not shown, of decompression gas. Valve (68) and associated hose (76) are connected to tank (82), not shown, containing an intermediate decompression gas with lower oxygen content. The decompression block (64) is connected to travel/bottom block (84) by isolation valve (86), which can be used to either connect or isolate the two blocks. The isolation valve can be a suitable two-way ball valve such as a Whitey series 40T stainless steel model (specification and testing 1), available from the WHITEY Company of Highland Heights, Ohio. Decompression valves (66) and (68) are essentially identical valves such as Nupro P4T series plug valves (specification and testing 2), available from the NUPRO Company of Willoughby, Ohio, and are connected to Hansen Stem D.E.S.O. two-way quick disconnects (70) and (72), available from Amron International Diving Supply of San Diego, Calif. These plug valves require only about 90 degrees' rotation of their tee handles (88) between full open and closed, and are installed so that the tee handles align longitudinally when they are both closed. Since the cross-pieces of the tee handles are hollow, when both valves are closed a safety bar (89) (not shown here) can be inserted and releasably secured in place. This prevents either decompression valve from being opened before the diver has taken the positive step of removing the safety bar.

The travel/bottom gas block (90) contains two Kirby Morgan adjustable valves (92) and (94) with standard SCUBA fittings (96) and (98) (specifications and testing 4) respectively, available from Diving Systems International, plus a Nupro P4T series plug valve (99) (specifications and testing 2) and a Hanson Plug D.E.S.O. quick disconnect (100) (specification and testing 5). Located between valves (92) and (94) and opposite valve (99) is releasable connection (102) for connecting hose 104 to the regulator.

Valves (92) and (94) control travel and bottom gases, respectively, and have large round or oval valve handles which turn counterclockwise at least about 180 degrees to open. In addition to their positions, these different shapes and actuating modes serve to distinguish the decompression valves from those for travel/bottom gases. Valve (99) and quick disconnect fitting (100) are placed on the opposite side of the block from the other valves to provide ready access for connecting a source of "bail-out" gas (carried on the diver's back not shown) for emergencies, or indeed any external source of breathing gas for decompression or emergency use.

Figures 3, 4, 5, 6:
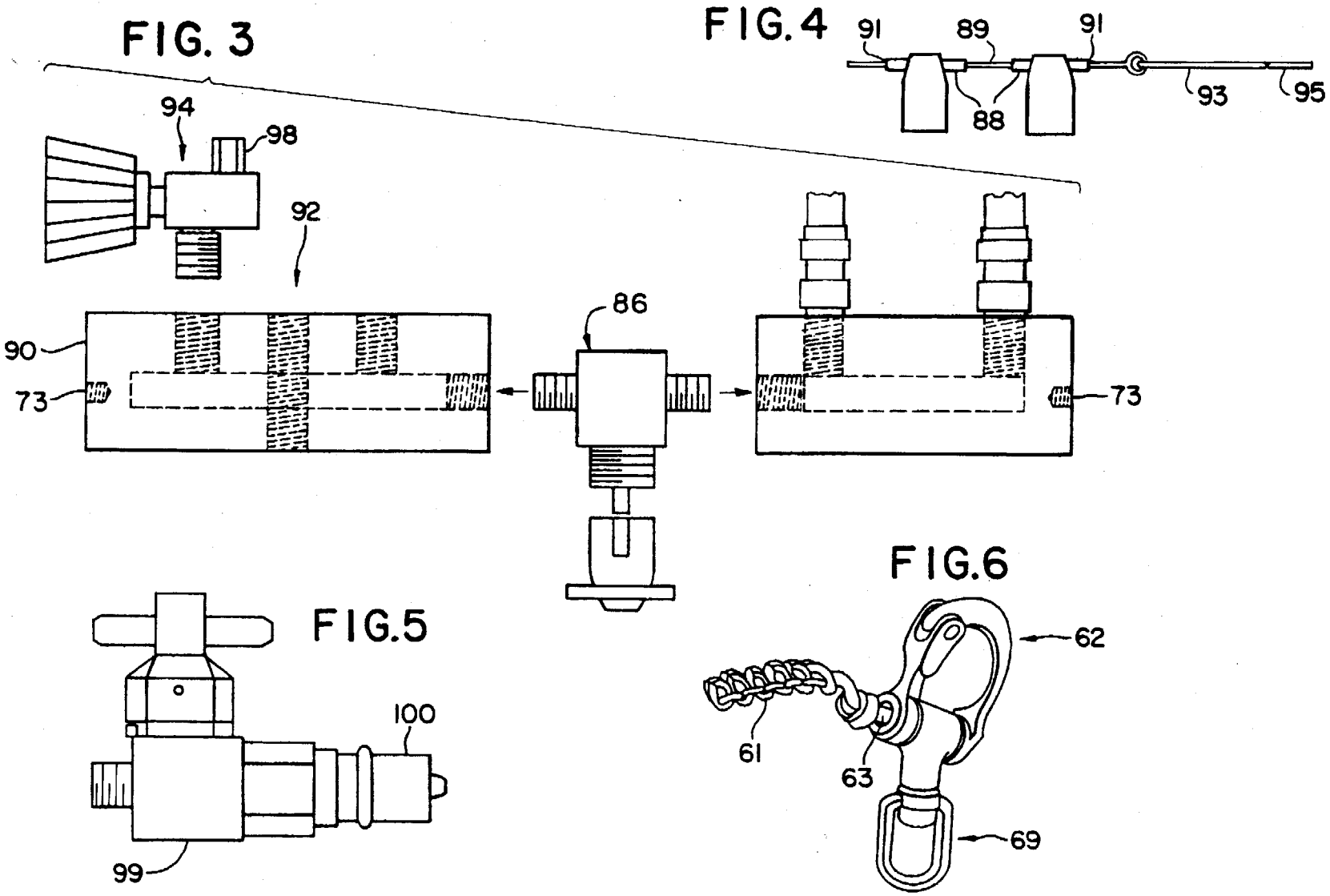
FIG. 3 is an exploded perspective view of the decompression gas switching manifold of the invention.
FIG. 4 is a plan view of the manifold of the invention.
FIG. 5 is a cross-sectional detail view of the "bail-out" gas valve (99) and quick disconnect (100).
FIG. 6 is a perspective view of the snap shackle (62) used to secure the manifold to the diving harness.

Turning now to FIGS. 3 and 4, the manifold's parts and accessories are shown in detail. Safety bar (89) is inserted through the holes (91) in the tee handle bars (88) to secure them in closed position, and is retained by cable (93), which is releasably attached to the diving harness by clip (95) or other suitable fastening means.

Figure 7:
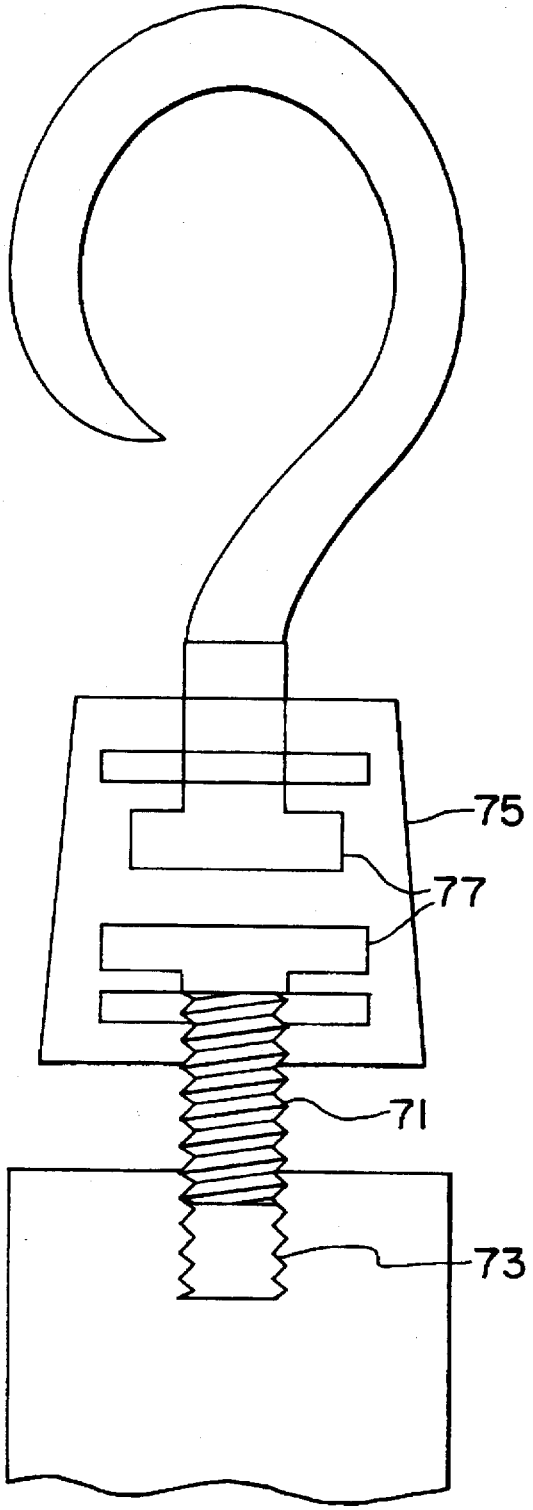
FIG. 7 is a cross-sectional view of a means of attaching the shackle(s) to the manifold block, according to the present invention.

FIG. 5 illustrates the valve (99) and quick disconnect (100) in detail, while FIG. 6 illustrates the shackle (62) used to secure the manifold to the diving harness. The shackle can be opened by pulling retractable pin (63) with cable loop (61) to release hook (67). The pin can be secured in place by thumbscrew (65). The shackle preferably includes a rotatable trunnion fitting (69) which provides a connector for the block and an additional degree of freedom. As seen in FIG. 7, the shackle(s) can be attached to the upper end (and optionally, to the lower end as well) of the manifold block by screwing threaded stud (71) into a threaded socket (73) in the block. Optionally, a flexible fitting (75) can be used between the block and the shackle, to retain thumbscrews (77) in rotatable positions.

DECOMPRESSION GAS SWITCHING MANIFOLD

Description

The decompression gas switching manifold (60) is preferably completely constructed of 316 grade stainless steel and consists of two main sections, the decompression gas block (64) and the travel/bottom gas block (84). The two sections are isolated by isolation valve (86), a Whitey series 40T stainless steel ball valve (specification and testing 1 or the like).

The decompression gas block incorporates two Nupro P4T series plug valves (66) and (68) (specification and testing 2 or the like); with two Hanson Stem D.E.S.O. quick disconnects (specifications and testing 3), one stainless steel trunnion ball shackle (62) and one stainless steel cabled safety bar (89).

The travel/bottom gas block (84) utilizes two Kirby Morgan valves (92) and (94) with standard SCUBA fittings (96) and (98) (specifications and testing 4), one Nupro P4T series plug valve (99) (specifications and testing 2) and one Hanson Plug D.E.S.O. quick disconnect (100) (specification and testing 5). The manifold blocks and valves should be made of the highest quality stainless steel or brass, with connections machined carefully to provide torque-tightened fits which will prevent the escape of helium-mix breathing gases at up to acceptable maximum pressures.

Each valve should have a flow coefficient Cv of the inner valve equal to at least about 0.1 to permit a sufficient airflow for the diver. To fit comfortably and conveniently on the diver's harness without adding excessive weight, the complete manifold block assembly should be less than about ten inches long, and is preferably less than about eight inches long. This requires careful design and machining so that the various adjacent valves can be installed and tightened in place without requiring excess clearance.

The valve handles are differentiated by location, type and, optionally, by color to assist the diver in choosing the correct valve(s) for each phase of the diver, even when emergency decompression may be required and/or the diver is affected by excesses of oxygen or nitrogen. (For a discussion of these hazards, see Allen's "Mixed Opinion: The British Sub-Aqua Club's Report on the Use of Enriched Air Nitrox," *Aqua Corps Journal* NG (June 1993), pp. 38–40.

Operation and Safety Features

The decompression gas switching manifold will allow an independent untethered diver wearing a full face mask to make the necessary gas switches for any decompression obligation. As stated above and shown in FIG. 2, the decompression gas switching manifold is attached to the diver's chest harness by at least one stainless steel snap shackle (62) on the right side. All gas hoses will be routed under the diver's right arm. The decompression gas switching manifold incorporates a generic and tactical gas identification system for the correct selection of specific gases. Additionally, there are two safety features, and one fail safe design element. The generic feature is that, starting from the top of the manifold as worn, the part that is connected to the chest harness via the snap shackle, the gases entering are positioned with the highest fraction of oxygen ($FO_2$) on top running to the lowest fraction of oxygen ($FO_2$) on the bottom (decompression gas top, bottom gas bottom). Tactically, the high fraction of oxygen ($FO_2$) gases are controlled by one fourth turn (T-bar handle) plug valves, and the low fraction of oxygen gases ($FO_2$) are controlled by Kirby Morgan Stem valves that operate with large round plastic knobs which must be rotated counterclockwise at least about 180 degrees to full open.

The first safety feature is the main design of the manifold, which is actually two separate blocks connected by an isolation valve. The isolation valve is normally closed when the diver enters the water, separating the high fraction of oxygen gases (Decompression) from the bottom mix. Only upon ascending after the dive is the isolation valve opened to allow access to the decompression mixes.

The second safety feature is a cabled safety bar (89) that is inserted in the hollow stainless steel tee bar handles (88) of the closed decompression gas valves, effectively locking them closed and preventing an accidental opening until its removal by the diver.

The fail safe element of the decompression gas switching manifold is in the set up of all first stage regulators connected to it. A pressure differential of two to four PSI higher settings on the low fraction of oxygen gas regulators (bottom gas), in contrast to the high fraction of oxygen regulators, will prevent any decompression gases from entering the face mask as long as the bottom gas mix valves are open. In essence, if during the working phase of the dive, when the diver is breathing bottom mix gas (valve open), even if the isolation valve is accidentally opened, the cabled safety bar is removed and a decompression gas valve is accidentally opened, the diver will still be breathing bottom mix gas and the high fraction of oxygen gas will not mix with it.

Configuration A.

The diver enters the water with the bottom mix valves open, two travel mix valves closed, the isolation valve closed and the decompression valves closed and locked off by the safety bar. Upon completion of the dive and starting the ascent, the diver removes the safety bar, opens the isolation valve and upon reaching his first decompression stop opens his intermediate decompression gas valve (second one down from top) and closes the two bottom mix valves (two bottom valves) the diver then ascends to the final decompression depth, where the top valve is opened (Highest Fraction of Oxygen) and the intermediate valve closed. The decompression is then completed breathing this mix.

Configuration B.

The diver enters the water with the travel mix valve opened, bottom mix valves closed, isolation valve closed, decompression valves closed and locked off by the safety bar; upon reaching the bottom the bottom mix valves are opened and the travel mix valve is closed. Later, decompression follows Configuration A.

EXAMPLES

The invention will be further illustrated by the following nonlimiting examples.

On Jul. 14–17, 1993 Applicant participated in a dive expedition to the SS Andrea Doria, aboard the R/V Wahoo, (out of Captree Boat Basin, Long Island, N.Y.) The Andrea Doria was an Italian cruise liner that sank off the northeast coast of the United States in 1956. It lies in 256 feet of water and is considered the Mt. Everest of diving in this area. It is a technically difficult dive due to the depth, which necessitates decompression; the current, which always is running strong in this area, and the cold water, which is never above 50° F. even in summer.

Applicant's Dive Profile (depth and time) obligated him to make three gas switches in order to complete decompression safely. At the beginning of the ascent from 256 feet, he had to switch from the bottom mix, 50% He, 33% $N_2$, 17% $O_2$) at 110 feet, to a first Nitrox Mix (36% $O_2$, 64% $N_2$) which he carried.

Upon reaching 50 feet, Applicant was supposed to switch to a second Nitrox Mix (50% $O_2$, 50% $N_2$). However, as these tanks were suspended from the boat on lines and he was ascending the anchor line which was tied into the wreck and under great strain from the current, he could not even see the SCUBA tanks, let alone reach them. The great angle of the anchor lines put the diver at excessive distance from the Nitrox tanks, which were hanging straight down from the boat.

Continuing to breath the first Nitrox Mix (36% $O_2$, 64% $N_2$) the diver went on with the decompression schedule (breathing the wrong gas) until he reached the 20 feet stop, where he was supposed to switch to oxygen. The oxygen regulators were attached to a trapeze, also suspended underneath the boat.

The current was running so strongly that it formed an upwelling as it streamed across the sunken wreck. The diver knew he was going to have difficulty maintaining depth (20 feet) which is critical in decompressing, when he let go of the anchor line, but he had no choice. As expected, upon releasing the anchor line to swim to the oxygen trapeze, the diver was hurled straight up underneath the boat and just managed to grab the trapeze line and drag himself under again. At that point he was forced to recalculate the decompression schedule and do a long extended emergency decompression, which is dangerous in itself, because long exposures to oxygen partial pressure of 1.6 ATM and above can bring on seizures.

Applicant was determined after that experience to incorporate a safer diving configuration for this type of technical diving.

The system required three things:

- a full face mask/regulator to eliminate immediate drowning in the case of an oxygen seizure;
- the ability to carry all gases needed to complete the dive and decompression; and
- a manifold block permitting the diver to switch to each gas as needed while wearing the full face mask.

Upon returning to the Andrea Doria in July 1994, again aboard the R/V Wahoo, Applicant conducted the same dive profile he had attempted in 1993. This time his equipment incorporated a full face mask diving rig carrying all the gases needed for the dive and decompression, with the ability to switch to the required gas via the manifold block of the invention he had manufactured. The dive went off without incident, including two decompression stages using self-carried gas mixtures.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A decompression gas switching manifold for technical diving, comprising a first manifold block containing connection and valve means for connecting and controlling the flow of at least one of two separate breathing gas mixtures for decompression operations to a diver's breathing regulator, a second manifold block containing connection and valve means for connecting and controlling at least one of two separate bottom/travel gases, connection and valve means for connecting a source of bail-out gas and a quick disconnect fitting for connecting the manifold to said breathing regulator, with isolation valve means for isolating or interconnecting said first and second manifold blocks.

2. The gas switching manifold of claim 1 wherein the valve handles on said first block are the same in form and function, but differ in form and function from the handles for both valves for bottom/travel gases on said second block.

3. The gas switching manifold of claim 1 wherein locking means are provided for simultaneously locking both decompression gas valve handles on said first block in the closed position.

4. The gas switching manifold of claim 3 wherein the handles of said valve means comprise hollow T fittings which turn the valve stems approximately 90 degrees from full open to full closed and said locking means comprise a rod adapted to be inserted through both hollow T fittings when they are aligned longitudinally in their closed positions.

5. The gas switching manifold of claim 1 wherein the valve handles for said bottom/travel gases are identical in form and function, but differ in each from said valves for decompression gases.

6. The gas switching manifold of claim 5 wherein said valve handles for bottom/travel gases comprise cylindrical, oval or spherical components and require at least about 180 degrees travel between full open and closed.

7. The gas switching manifold of claim 1, further comprising at least one snap shackle removably attached thereto for attachment to a diving harness.

8. The gas switching manifold of claim 7, wherein said at least one snap shackle is a trunnion type snap shackle having at least two degrees of freedom which is removably attached to said manifold block by a threaded stud screwed into a threaded hole therein.

9. A technical diving outfit comprising a diving harness, a full face mask, a decompression gas switching manifold of claim 1 removably attached to the right front portion thereof by at least one snap shackle with the decompression gas valves uppermost, and further comprising two sources of decompression gas, two sources of bottom gas and a source of bail-out gas, all connected appropriately to said manifold block and regulators for said full face mask.

10. The diving outfit of claim 9 wherein the regulator pressures for said bottom gases are set about 2 to 4 psi higher than the pressure for the decompression gas regulator.

11. A method of technical diving employing the diving rig of claim 10.

12. The method of claim 11 wherein the diver enters the water with bottom mix valves open, travel mix valves closed, the isolation valve closed and both decompression valves closed and locked, then upon completion of the dive and starting ascent the diver unlocks said decompression valves, opens said isolation valve and upon reaching his first decompression stop opens the intermediate decompression gas valve and closes the two bottom mix valves, thereafter ascending to the final decompression depth, where the decompression gas valve is opened and the intermediate decompression valve is closed to complete the decompression process.

13. The method of claim 11 wherein the diver enters the water with the travel mix valve opened, the bottom mix valves closed, isolation valve closed and decompression valves closed and locked, and upon reaching the bottom opens the bottom mix valves and closes the travel mix valve; thereafter, upon completion of the dive and starting ascent the diver unlocks said decompression valves, opens said isolation valve and upon reaching his first decompression stop opens the intermediate decompression gas valve and closes the two bottom mix valves, thereafter ascending to the final decompression depth, where the decompression gas valve is opened and the intermediate decompression valve is closed to complete the decompression process.

14. A decompression gas switching manifold for technical diving for selectively delivering at least one of a plurality of breathing gas mixtures to a breathing regulator, said manifold comprising:

a first elongated manifold block formed to include at least one internal passage therein, said first manifold block having at least one gas inlet means for admitting the flow of a first-type breathing gas mixture into said internal passage of said first manifold block;

a second elongated manifold block formed to include at least one internal passage therein, said second manifold block having at least one gas inlet means for admitting the flow of a second-type breathing gas mixture into said internal passage of said second manifold block;

at least one gas outlet means for allowing flow out of said internal passage of said second manifold block; and an isolation valve means for interconnecting said first and second manifold blocks in axial alignment and for controlling gas flow between said internal passages of said first and second manifold blocks.

15. The gas switching manifold according to claim 14 wherein said first-type breathing gas mixture is a decompression gas mixture; and wherein said second-type breathing gas mixture is a bottom/travel gas mixture.

16. The gas switching manifold according to claim 14 wherein said first manifold block is formed to include a first elongated internal passage, and wherein said first manifold block further comprises:

a first decompression gas inlet means for admitting the flow of a first decompression gas mixture into said first elongated internal passage; and a second decompression gas inlet means for admitting the flow of a second decompression gas mixture into said first elongated internal passage;

wherein said second manifold block is formed to include a second internal passage, and wherein said second manifold block further comprises:

a first bottom/travel gas inlet means for admitting the flow of a first bottom/travel gas mixture into said second elongated internal passage; and a second bottom/travel gas inlet means for admitting the flow of a second bottom/travel gas mixture into said second elongated internal passage.

17. The gas switching manifold according to claim 14 wherein said second manifold block further comprises a bail-out gas inlet means for admitting the flow of a breathing gas mixture into said second elongated internal passage.

18. The gas switching manifold according to claim 17 wherein said bail-out gas inlet means further comprises a quick-disconnect fitting; and wherein said gas outlet means further comprises a quick-disconnect fitting.

19. The gas switching manifold according to claim 15 wherein each of said gas inlet means of said first and second manifold blocks further comprise a valve means having a valve handle.

20. The gas switching manifold according to claim 19 wherein said valve handles of said first manifold block are the same in form and function, but differ in form and function from the handles of said second manifold block.

21. The gas switching manifold according to claim 20 wherein said gas inlet means of said first manifold block are disposed along one side of said manifold, wherein said manifold further comprises a releasable locking means for engaging said valve handles on said first manifold block and substantially preventing the turning of said valve handles.

22. The gas switching manifold according to claim 21 wherein said locking means further comprises a locking rod, wherein the valve handles of said gas inlet means are provided with a throughhole, and wherein said locking rod is adapted to be inserted into said throughholes when said valve handles are aligned longitudinally in a closed position, thereby simultaneously locking said valve handles.

* * * * *